United States Patent [19]

Lundblad et al.

[11] 4,343,582

[45] Aug. 10, 1982

[54] BANKNOTE DISPENSING APPARATUS

[75] Inventors: Leif J. I. Lundblad, Huddinge; Jan-Olof Ek, Alvsjo, both of Sweden

[73] Assignee: Inter Innovation AB, Stockholm, Sweden

[21] Appl. No.: 139,525

[22] Filed: Apr. 11, 1980

Related U.S. Application Data

[63] Continuation-in-part of Ser. No. 950,115, Oct. 10, 1978, abandoned.

[30] Foreign Application Priority Data

Oct. 11, 1977 [SE] Sweden ..... 7711412

[51] Int. Cl.³ ..... G07D 1/00; B65H 3/04

[52] U.S. Cl. ..... 414/32; 414/43; 414/104; 414/107; 414/330; 271/303; 198/436; 198/367

[58] Field of Search ..... 414/32, 43, 330, 104, 414/107, 112; 271/279, 64, 300, 302-304; 221/252; 198/436, 367, 442; 194/DIG. 26

[56] References Cited

U.S. PATENT DOCUMENTS

| | | | |
|---|---|---|---|
| 2,484,196 | 10/1949 | Turrall | 271/64 X |
| 2,697,514 | 12/1954 | Stahl | 271/64 X |
| 3,795,395 | 3/1974 | Ransom | 271/64 X |
| 3,938,435 | 2/1976 | Suda | 271/64 X |
| 4,030,607 | 6/1977 | Suda | 271/64 X |
| 4,050,562 | 9/1977 | Schwippert | 414/43 X |
| 4,119,194 | 10/1978 | Freeman | 414/330 X |
| 4,150,757 | 4/1979 | Laybourn | 271/64 X |
| 4,159,782 | 7/1979 | Swartzendruber | 221/21 X |
| 4,166,030 | 8/1979 | Lewis | 271/64 X |

*Primary Examiner*—Edward R. Kazenske
*Assistant Examiner*—Terrance L. Siemens
*Attorney, Agent, or Firm*—Sughrue, Mion, Zinn, Macpeak and Seas

[57] ABSTRACT

A currency dispensing apparatus has a plurality of customer receipt openings to which an ordered number of banknotes can be sent from a store of banknotes in response to an order signal. The banknotes are dispensed to a collector station through a first feed mechanism in response to the transmitted order signal, and from the collector station to a selected receipt opening by a second feed mechanism which cooperates with a switching device for determining the direction of feed of the second feed mechanism.

6 Claims, 6 Drawing Figures

BANKNOTE DISPENSING APPARATUS

This is a Continuation-In-Part of application Ser. No. 950,115, filed Oct. 10, 1978, now abandoned.

The present invention relates to a dispensing apparatus, and more particularly, although not exclusively, to an apparatus for dispensing banknotes in such localities as banks, postoffices, hotels etc.

Although the invention is directed to and described with reference to an apparatus for dispensing an ordered number of banknotes, it will be understood that the apparatus can also function to dispense any suitable sheet-like elements.

Sheet dispensing apparatus, such as currency dispensing apparatus for dispensing an ordered number of banknotes from a store thereof to a banknote receiving station are known to the art.

These known apparatus, however, are designed and constructed to serve only a single banknote receiving station, thus restricting the use of such apparatus to one customer at a time.

It is therefore an object of the invention to provide apparatus able to serve a plurality of customer receipt openings, thereby enabling more than one customer to use the apparatus at any time.

Accordingly the invention consists in a dispensing apparatus for dispensing an ordered number of banknotes from a banknote storage means to a customer, said apparatus comprising (a) a plurality of customer receipt openings;

(b) means for ordering a given number of banknotes to be dispensed from the storage means to a selected one of said customer receipt openings;

(c) first feed means co-operating with said ordering means to feed said ordered number of banknotes to a collective station;

(d) second feed means co-operating with said first feed means to feed the banknotes located in the collector station to the selected customer station, said means co-operating with switching means for determining the direction of feed of said second feed means; and (e) electronic devices for controlling the sequence of dispensing operations.

Figure 1:
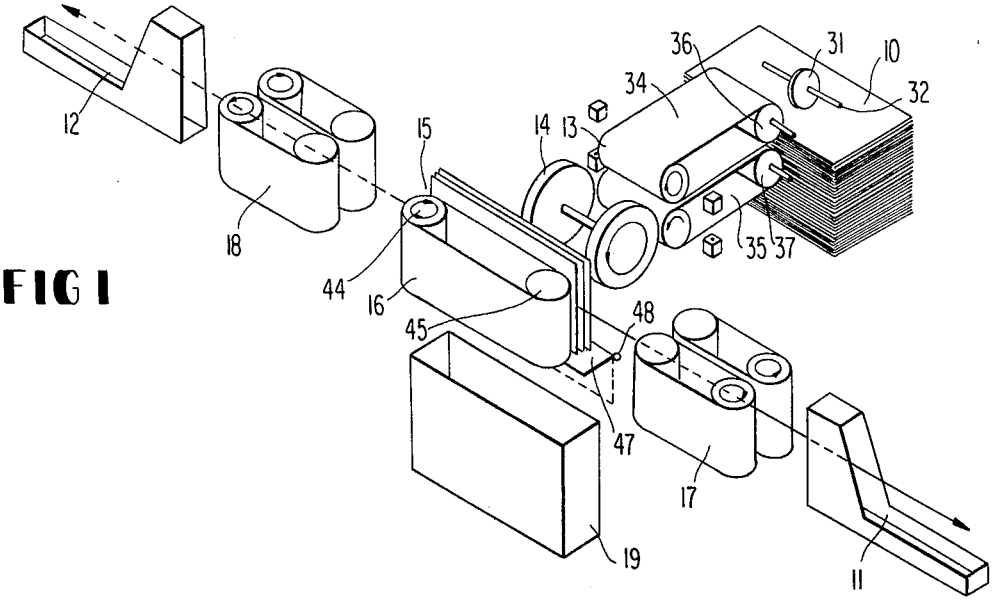
Figure 3:
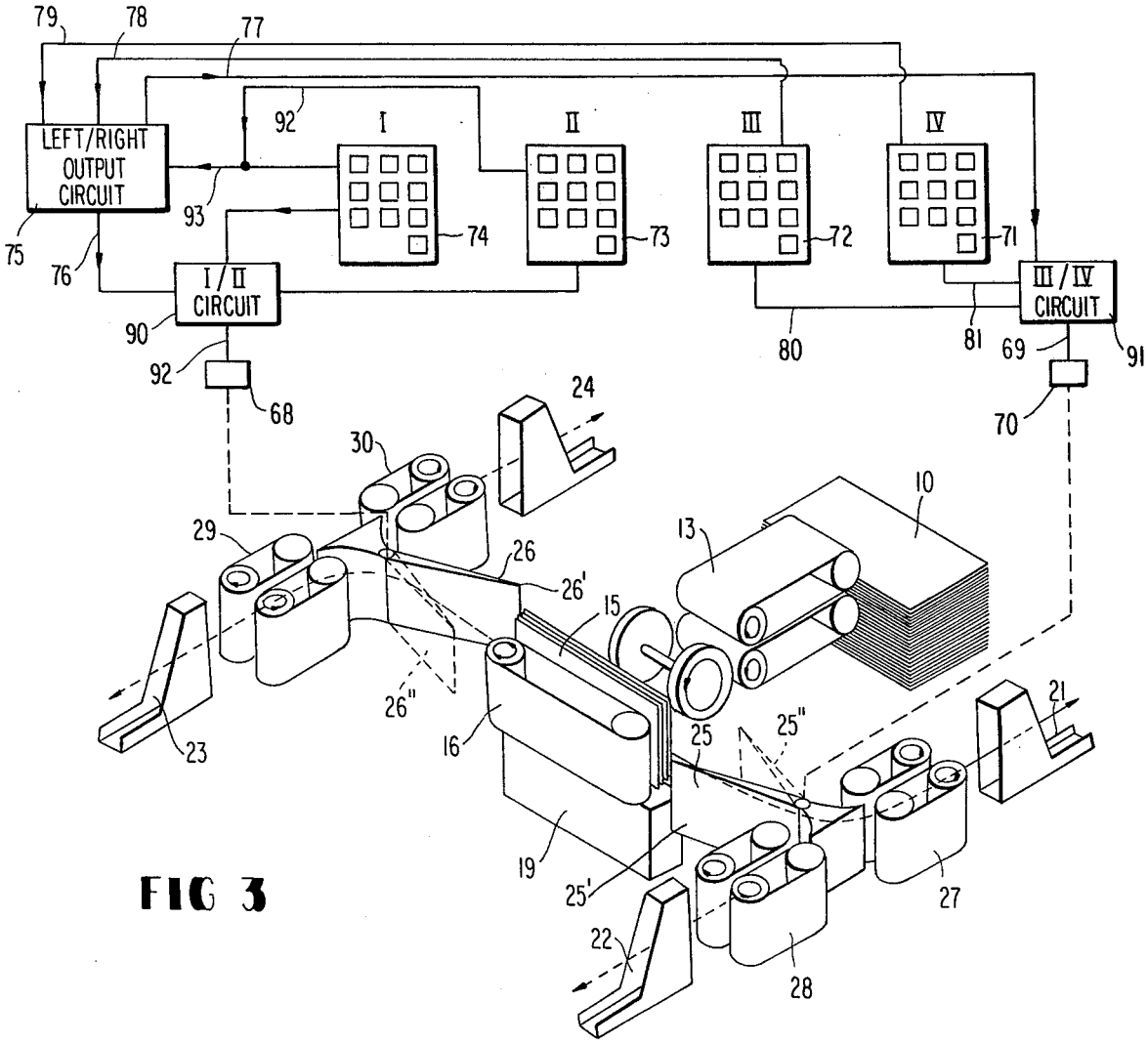
Figure 2:
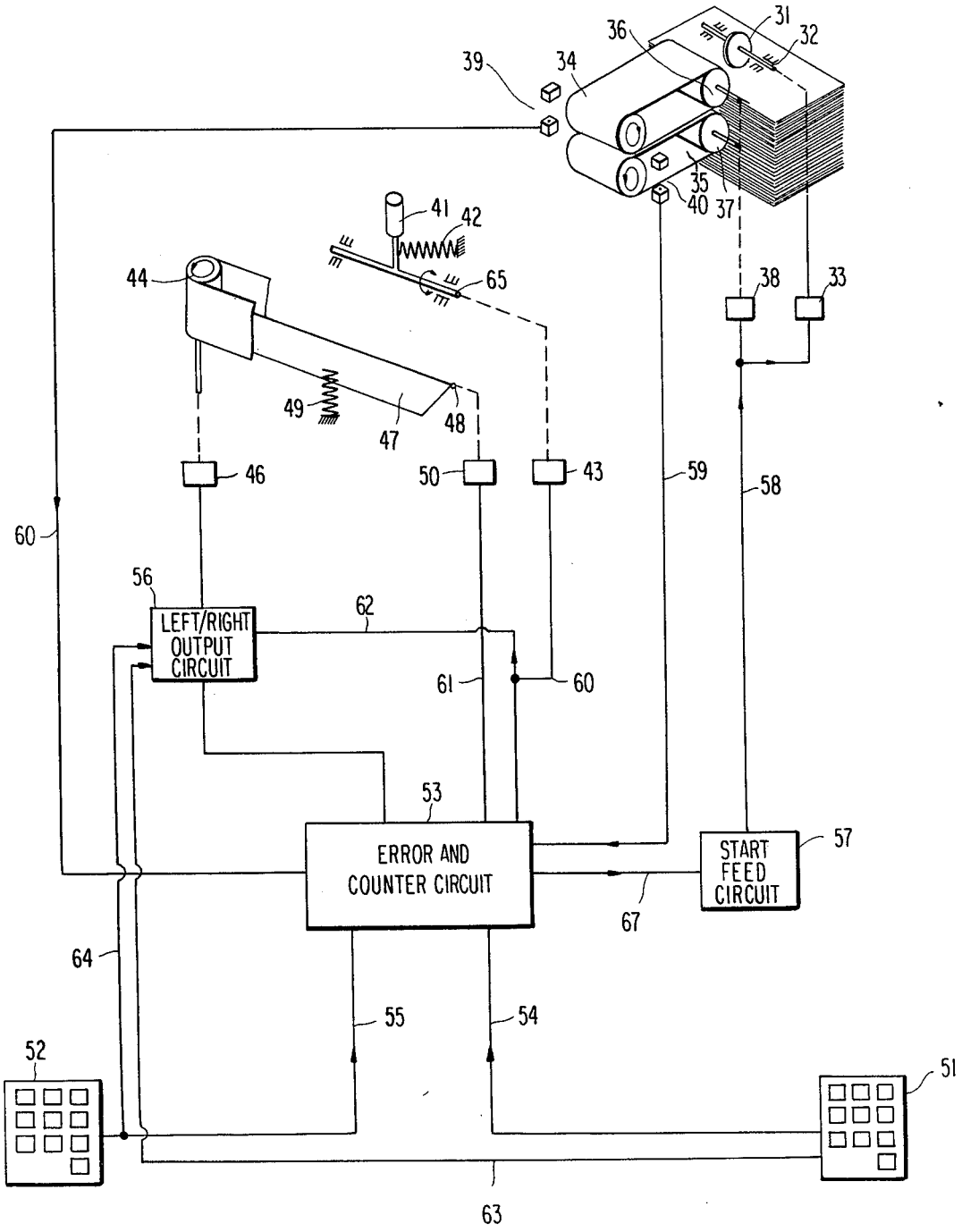
Figure 4:
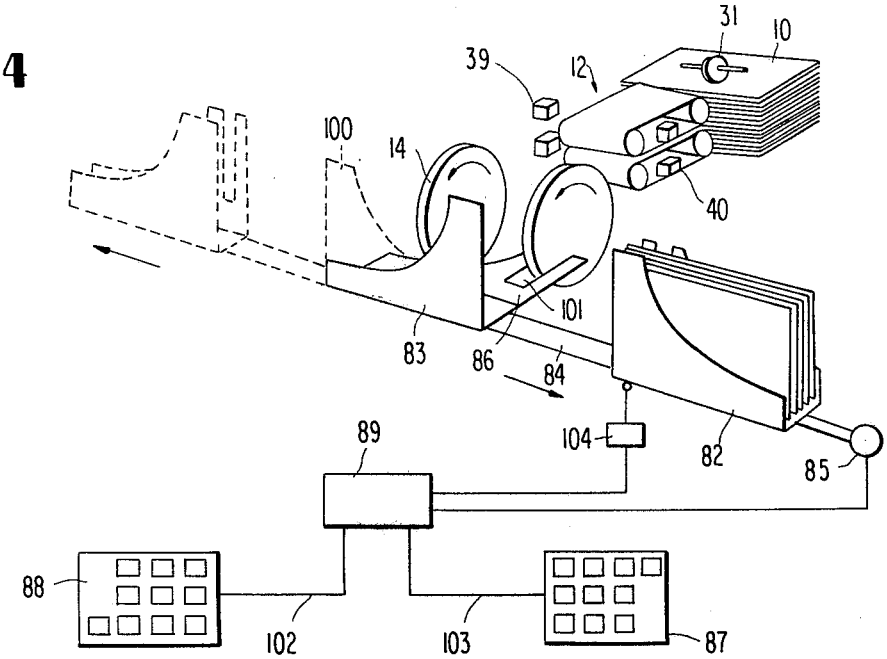
Figure 5:
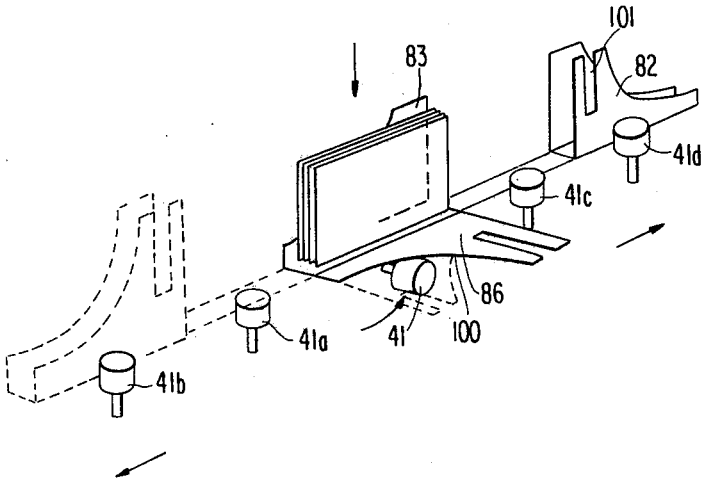
Figure 6:
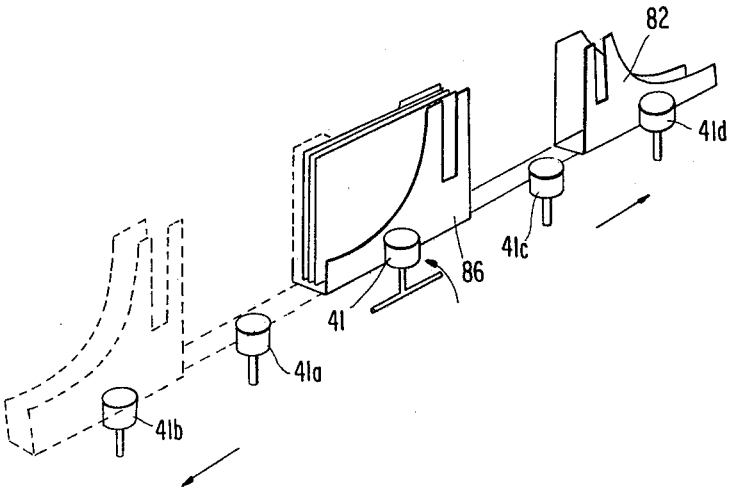

FIG. 1 illustrates an apparatus according to the invention having two receipt openings, FIG. 2 is a circuit diagram showing the various electric components of apparatus constructed in accordance with the invention, FIG. 3 illustrates an apparatus according to the invention having four receipt openings, and FIGS. 4 to 6 illustrate a further apparatus according to the invention having two receipt openings and two banknote collector means arranged for movement towards and away from said means.

By receipt opening is meant that receiving station to which a given number of banknotes are dispatched as a result of instructions given to the apparatus.

The apparatus illustrated in FIG. 1 is intended for dispensing banknotes from a bundle 10 of banknotes to each of two receipt openings 11,12, forming part of said apparatus. The apparatus comprises first banknote conveying means 13,14 effective to convey banknotes from the bundle 10 to a banknote collector 15, and second conveying means 16–17 and 16–18 respectively effective to convey the banknotes from the collector 15 to a respective one of the receipt openings 11 and 12. More specifically, the first banknote conveying means 13–14 comprises two mutually-coacting endless belts 34 and 35 between which the banknotes are fed one at a time to two rollers 14 mounted on a common shaft, said rollers being arranged to rotate counterclockwise in a manner such as to convey the banknotes, one at a time, to the collector 15. The banknotes are fed from the bundle 10 by means of a dispensing wheel 31 arranged to dispense one banknote from the bundle 10 with each revolution. The dispensing roller 31 is mounted on a shaft 32 driven by a motor 33, as shown in FIG. 2. It should be mentioned here that the drawing is purely schematical and is intended only to illustrate the principal construction and operation of the apparatus. Thus, for example, the collector 15 of the FIG. 1 embodiment is not shown to have walls, but the reference 15 merely shows where said collector is located in relation to other elements of the apparatus. The collector 15 is provided in the illustrated embodiment, with a swingable, rectangular bottom 47 mounted on a shaft 48. When the ordered number of banknotes is dispensed correctly from the bundle 10, the bottom 47 is arranged to be held in a substantially, horizontal, note-receiving position by means of a spring 49. (FIG. 2). If, for some reason, more than one banknote is dispensed from the bundle 10 at the same time, the bottom 47 is arranged to swing down into a substantially vertical note-reject position by means of an electric drive means 50, whereupon the banknotes fall into a reject-receptacle 19 located beneath said bottom. It will be understood that the banknotes are fed to the collector 15 so oriented that they are able to pass readily through the receipt openings 11,12 when fed thereto.

The collector 15 can also be said to comprise part of said second conveying means, which said part also includes an endless belt 16 mounted on rollers 44 and 45 having substantially vertical axes, of which rollers one, 44, is driven by means of a reversible motor 46 (FIG. 2), such that the direction of rotation of the rollers 44,45 can be changed in dependence upon the direction in which the banknotes are to be fed, i.e. whether the banknotes are to be fed to the receipt opening 12 or the receipt opening 11. Arranged between the collector 15 and the receipt opening 12 and receipt opening 11 are further conveying means 18 and 17 respectively. Each of these further conveying means comprises two mutually co-acting endless belts. The banknotes are conveyed from the collector 15 to the receipt opening 11 by means of the belt 16 and the further conveying means 17, and to the receipt opening 12 by means of the belt 16 and the further conveying means 18, the sequence of operations being controlled electronically in a manner hereinafter described with reference to FIG. 2.

Referring now to FIG. 2, it will be seen that the shaft 32 of the banknote dispensing roller 31 is driven by a motor 33 which is energized by means of a signal sent thereto by a start-feed circuit 57 over an electrical conductor 58. The signal sent from the circuit 57 over the conductor 58 also activates a drive motor 38 which causes the driven rollers 36,37 to rotate, thereby dispensing banknotes to the rollers 14. Arranged in the feed path of the banknotes dispensed from the bundle 10 are pairs of detecting means 39,40 which may have the form of optosensors, each being arranged to send a lightbeam through a note travelling between the belts 34,35, and to emit an electric signal having a first value, e.g. a value of 10 volts, when a single note is located between the belts, and a signal having a second value, e.g. a value of 5 volts, when two banknotes are located between the belts at the same time.

(The first signal is hereinafter referred to as the counting signal, while the second signal is referred hereinafter as the signal.)

These signals are sent to an error and counter circuit 53 over conductors 59 and 60 in a manner hereinafter made apparent. Although not shown in FIG. 1, there is located between the rollers 14 and collector 15 a spring-biassed drive means in the form of a press roller 41. The roller 41 is mounted on a substantially horizontal shaft 65 to which there is connected a drive means 43, e.g. an electric-magnetic drive device. While banknotes are being dispensed from the bundle 10 to the collector 15, the press roller 41 is rotated to a position outside the path of said banknotes and held in said position by means of the drive device 43. Subsequent to the ordered number of banknotes being dispensed, the drive device 43 is de-energized and the press roller swung to a substantially vertical position by means of a spring 42.

As beforementioned the collector 15 comprises a rectangular bottom 47 pivotally mounted on a shaft 48, to which there is connected a drive means, e.g. a motor 50. When banknotes are being dispensed from the bundle 10, the bottom 47 is held in a note-receiving position, e.g. a substantially horizontal position by means of a spring 49.

The receipt opening 12 is arranged to co-operate with a keyboard 52 while the receipt opening 11 is arranged to cooperate with the keyboard 51. Each of the keyboards 51,52 is connected to the error and counter circuit 53 through electrical conductors 54,55 respectively. The keyboards 51,52 are also connected through a respective electrical conductor 63,64 with a left-right output circuit 56, which is also connected to the error and counter circuit through an electrical conductor 62, and which is operative in causing the roller 44 to rotate in the appropriate direction.

The embodiment illustrated in FIG. 1 has the following mode of operation, reference being made at the same time to FIG. 2. When wishing to draw money from an account through the illustrated apparatus, the user punches the desired sum into either the keyboard 51 or the keyboard 52. Since, the sequence of electrical operations are identical with respect to both keyboards, the following description will be made solely with reference to keyboard 51, i.e. the keyboard serving the receipt opening 11, i.e. the receipt opening shown to the right of FIG. 1.

A signal corresponding to the ordered number of banknotes is sent from the keyboard 51 through the conductor 54 to the error and counter circuit 53, in which said number is stored in a counter, (not shown) incorporated therein, which counter may be of any suitable design. A signal is then sent to the start feed circuit means 57 over an electric conductor 67, informing that the dispensing of banknotes from bundle 10 can commence. A signal is then sent from the start-feed circuit 57 to the motor 33 which causes the dispensing roller 33 to rotate, and also to the motor 38 which is then energized to rotate the rollers 36,37 of the feed means 34 and 35 respectively. At the same time a signal is sent from the error and counter circuit to the drive means 43 over an electric conductor 60, causing the shaft 65 to be rotated so that the press roller 41 lies out of the path of the dispensed banknotes. As mentioned, the rectangular bottom 47 is held in its horizontal banknote-receiving position by the spring 49. The presence of each banknote dispensed through the belts 34,35 is detected by the detecting means 39,40 and a signal is sent from said detecting means through respective conductors 60, 59 to the error and counter circuit 53. When the counter in said circuit has been counted down to zero, a signal is sent from said error and counter circuit to the start feed circuit causing the motors 38 and 33 to be stopped, so that no further banknotes are dispensed. Subsequent to dispensing the ordered number of banknotes to the collector 15, a signal is sent from the error and counter circuit to the drive means 43 over conductor 60, causing said drive means to be de-energized, so that the press roller 41 can be raised to an upright position in engagement with the banknotes in said collector by said spring 42. At the same time, a signal is sent from said error and counter circuit to the left-right output circuit 57, which upon receipt thereof sends a signal to the reversible motor 46. Since the banknotes were assumed to be ordered through the keyboard 51, i.e. the keyboard which serves the receipt opening 11, the signal sent to the reversible motor 46 will cause the roller 44 to be rotated in a direction such that the banknotes in collector 15 are fed to the second feed means 17 and from there to said receipt opening 11. It will be understood that if the banknotes were ordered through keyboard 52, the direction of the motor 46 will be reversed so that the roller 44 is rotated in direction such that the banknotes in collector 15 are fed to the second feed means 18 and from there to the receipt opening 12.

If, for some reason or other, more than one banknote at a time is fed to the belts 34,35 by the roller 31, this will be detected by the detectors 39,40, and an error signal having said second value of 5 volts will be sent to the error and counter circuit 53, from which a signal is then sent from said circuit to the drivemeans 50 causing the rectangular bottom 47 to be swung down into a substantially vertical position against the spring 49, thereby permitting banknotes to fall into the reject receptacle 19.

The apparatus illustrated in FIG. 3 comprises the elements 10,13,14,15,16 and 19 illustrated in FIG. 1 and, in addition hereto, two path-determining means 25,26 and further conveying means 27,28,29,30 forming part of the second conveying means. The path-determining means 25,26 are arranged to move between two given positions 25',25'' and 26',26'', respectively, these positions determining to which of the four possible receipt openings 21,22,23,24 a bundle of banknotes is despatched. Thus, when the means 25 occupies the position 25' as shown in FIG. 2 banknotes are conveyed from the collecting chamber 15 to the receipt opening 21 by means of the belt 16, the path-determining means 25 and further conveying means (the belt) 27. When the means 25 occupies the position 25'', the banknotes are conveyed instead to the receipt opening 22, by means of the belt 16, the path-determining means 25' and further conveying means (the belt) 28.

By reversing the direction of rotation of the belt 26 (to a counterclockwise rotation) the bundle of banknotes can be conveyed in an analogous manner, instead to the receipt opening 23, by moving the path-determining means 26 to the position 26', or to the receipt opening 24, by moving the path-determining means to the position illustrated at 26''. All sequences of operations are, as beforementioned, controlled electronically.

As will be seen from FIG. 3 the dispensing of banknotes from the bundle 10 to the receipt openings 23,24 is governed by a respective keyboard 73,74 through a I/II circuit 90 connected electrically to keyboard 73,74 by electric conductors 93,92, while the dispensing of banknotes from said bundle to the receipt openings 21,22 is governed through a III/IV circuit 91 connected to keyboards 71,72 over conductors 81,80 respectively. As will be seen from FIG. 3, keyboards 74,73 are also referred I and II respectively, and keyboards 72,71 are also referenced III and IV respectively, hence the designation I/II circuit and III/IV circuit. The circuit 3 of the FIG. 3 embodiment also includes a left-right output circuit (here referenced 75) which is connected to the respective keyboards 71,22,73,74 by conductors 79,78,92 and 93 respectively. The left-right output circuit is also connected electrically to the I–II circuit 90 and to a III–IV circuit 91 by conductors 76,78 respectively, as shown in the Figure. As will be seen from the Figure, the I–II circuit is connected to a reversible motor 68 arranged to switch the position of the path-determining means 26, in dependence upon which of the keybanks 74,73 has been used, i.e. in dependence upon whether the banknotes shall be fed to the receipt opening 24 or the receipt opening 23. Similarly, the III–IV circuit is connected, over a conductor 69, with a reversible motor 70 arranged to switch the position of path-determining means 25 so that the ordered number of banknotes in the collector 15 is dispensed to the appropriate receipt opening 21 or 22. Although not specifically shown in FIG. 3, it will be understood that this embodiment may also include the circuitry of the FIG. 2 embodiment to ensure that in the case of double feeding the banknotes in collector 15 will be discarded into the banknote reject receptacle 19.

FIGS. 4, 5 and 6 illustrate schematically and partly in perspective an alternative embodiment of a banknote dispensing apparatus. As with the previous embodiments, an ordered number of banknotes is dispensed from a bundle 10 thereof by means of a driven roller 31 arranged such that one banknote is dispensed to the first conveying means 13,14 each time the roller 31 rotates. Also present in the FIG. 4 embodiment are the pairs of detecting devices 39,40, which have the same function of the detecting devices described with reference to the earlier embodiments. In this embodiment, however, the collector 15 of the earlier described embodiment is replaced by movable collector chambers, the illustrated embodiment having two such chambers. As shown in the Figures, the collector chambers, here referenced 82,83, are mechanically connected together by means 84 so that when one collector chamber, e.g. 83, is located in the banknote collecting station in register with the rollers 14, the other collector chamber 82 is located in a receipt opening, e.g. the receipt opening 12. Each of the chambers 83,82 comprises two side walls, of which one, 86, is collapsible so that it can be lowered out of the path of banknotes dispensed to the collector chamber and subsequently raised into engagement with said banknotes to form a compact sheaf which can be transported neatly to the respective receipt opening. In order to allow the feed rollers 14 to be located as close to the collecting station as possible, the collapsible wall 86 has a curved cut-away portion 100 and a slotted portion 101 in which the roller shown to the right of FIG. 4 can rotate. The dispensing of banknotes to a respective receipt opening, e.g. at the position occupied by collector chamber 82 in FIG. 4, is governed through a respective keyboard 88,87. Each of the keyboards is connected electrically over conductors 102,103 only to circuit means 89 similar to that of the FIG. 2 embodiment, said circuit means being shown very schematically. As will be understood, the direction in which a respective collecting chamber is driven is governed by a reversible drive motor, here referenced 85. As will be seen from FIGS. 5 and 6, which show the apparatus from a direction opposite to that of FIG. 4, the wall 86 of respective collector chambers 82,83 is lifted into an upright position by means of a collapsible press roller 41 similar to the press roller of the FIGS. 1 and 2 embodiment. Arranged along the path of movement of respective collector chambers are drive rollers **41*a*,41*b* and 41*c*,41*d*, respectively which are connected to the reversible drive motor 85 and which are operative in moving a collecting chamber to one or the other of the receipt opening, depending on the direction of rotation of the motor 85**.

As beforementioned the collector chambers 82,83 are mechanically connected together so that as one collector chamber is moved to its respective receipt opening, the other is moved into register with the banknote collecting station. It will be seen from this that subsequent to using the keybank 87 the collector chamber 82 will remain located in its associated receipt opening, while the collector chamber 83 associated with the keybank 88 will be located in register with the banknote collecting station. Thus, unless measures are taken, if the next order is given through keybank 87, the banknotes dispensed by roller 31 will be fed to the chamber 83 associated with keyboard 88. To overcome this, and to ensure that the chamber registered in the banknote collecting station, is that belonging to the keybank through which the order was placed the circuitry means 89 is also connected to a microswitch 104 which is actuated by a respective collector chamber 82 during its passage towards its associated receiving station. Thus, when an order is given through a respective keybank 87,88, a signal is sent to the position detecting means 85 which checks whether the banknote receiving opening of the relevant keyboard is free or occupied. If the receiving opening is free, dispensement of the banknotes takes place in the aforedescribed manner. If, on the other hand, the receipt opening is occupied, a signal is sent to the circuitry means which causes the collapsible wall of the chamber occupying the collector station to be raised and said collector chamber to be moved into its associated receipt opening, thereby causing the other collector chamber to be moved into register with the rollers 14, the collapsible wall of said chamber falling down, either gravitationally or by means of a spring force. Subsequent to a given delay, the motors to the drive means 13 and the dispensing roller 31 are energized so that feeding of the banknotes can commence. As will be understood the spacing of the rollers **41*a*, 41*b*, 41*c* and 41*d*** is such that the collapsible wall is held in its upright position during the whole of the travel of respective chambers from the collecting station to the associated receipt opening.

We claim:

1. An apparatus for dispensing an ordered number of banknotes from a banknote storage means to a customer, said apparatus comprising:

(a) a plurality of customer receipt openings;

(b) means for ordering a given number of banknotes to be dispensed from the storage means to a selected one of said customer receipt openings;

(c) first conveying means co-operating with said ordering means for feeding said ordered number of banknotes to at least one collector station;

(d) second conveying means co-operating with said first conveying means for feeding the banknotes located in the collector station to the selected customer station;

(e) switching means responsive to said ordering means for determining the direction of feed of said second conveying means such that said ordered number of banknotes is fed to the selected one of said customer receipt openings; and (f) electronic devices for controlling the sequence of dispensing operations.

2. An apparatus according to claim 1, characterized in that the collector station comprises part of said second conveying means, said part being arranged to move a bundle of banknotes present in said station in a given one of two directions to a selected one of two further conveying means, banknotes being conveyed from the collector station to a selected one of two receipt openings by means of the second conveying means and one of the two further conveying means, or to the other of said receipt openings by means of the second conveying means and the respective one of said further conveying means.

3. An apparatus according to claim 1, characterized in that the collector station comprises part of said second conveying means, said part being arranged to move a bundle of notes in said station in a given one of two directions to one of two further conveying means and in that switch means are arranged in a respective one of the two paths along which the banknotes are moved by said part of said second conveying means, each of said switch means being movable to one of two positions such that said bundle of banknotes can be transferred from said collector station to a selected one of four receipt openings.

4. An apparatus according to claim 1, in which two mutually identical collector stations form part of said second conveying means, said collector stations being mechanically coupled together, and the said second conveying means being arranged for movement in a given one of two directions in a manner such that one of the collector stations is moved to an associated receipt opening while the other of said collector stations is moved to the output side of the first conveying means, and vice versa.

5. An apparatus according to claim 4, comprising means for checking that two banknotes have not been fed from said storage means simultaneously, characterized in that each of the two collector stations is provided with a respective openable bottom so arranged that, when in a position adjacent the output side of the first conveying means and subsequent to receiving a signal from said checking means, the collector station opens to permit banknotes present therein to fall from said collector station to an internal storage chamber.

6. An apparatus according to claim 4, characterized by a bundling device arranged at the output side of the first conveying means for arranging the banknotes present in said collecting station at said output side into a neat bundle; and by further, corresponding bundling means arranged at the two receipt openings and constructed such that when the second conveying means is moved in either of said two directions they co-operate with the first mentioned bundling means in a manner such as to arrange the sheet-like elements into a neat bundle during transport to respective receipt openings.

* * * * *